US008585163B2

(12) United States Patent
Park

(10) Patent No.: US 8,585,163 B2
(45) Date of Patent: Nov. 19, 2013

(54) CONTAINER OF REFRIGERATOR

(75) Inventor: Jin Wook Park, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 287 days.

(21) Appl. No.: 12/738,985

(22) PCT Filed: Oct. 27, 2008

(86) PCT No.: PCT/KR2008/006335

§ 371 (c)(1),
(2), (4) Date: Apr. 21, 2010

(87) PCT Pub. No.: WO2009/061092

PCT Pub. Date: May 14, 2009

(65) Prior Publication Data

US 2010/0257891 A1 Oct. 14, 2010

(30) Foreign Application Priority Data

Nov. 5, 2007 (KR) ..... 10-2007-0111910

(51) Int. Cl.

| | |
|---|---|
| ***A47B 95/02*** | (2006.01) |
| ***A47B 96/04*** | (2006.01) |
| ***E05C 3/02*** | (2006.01) |
| ***E05C 3/12*** | (2006.01) |

(52) U.S. Cl.
USPC ..... 312/332.1; 312/404; 292/194; 292/219; 292/DIG. 11; 292/DIG. 37

(58) Field of Classification Search
USPC ..... 312/223.2, 333, 332.1, 402, 404, 408; 292/194, 219, 226, 227, 228, 95, 121, 292/122, 126–128, DIG. 11, DIG. 37
See application file for complete search history.

(56) References Cited

U.S. PATENT DOCUMENTS

| | | | | | |
|---|---|---|---|---|---|
| 2,749,167 | A | * | 6/1956 | Love | 292/226 |
| 3,208,781 | A | * | 9/1965 | Appleberry | 292/128 |
| 3,531,174 | A | * | 9/1970 | Poe | 312/333 |
| 5,769,515 | A | * | 6/1998 | Chang | 312/223.2 |
| 6,074,030 | A | * | 6/2000 | Prunty et al. | 312/404 |
| 6,076,869 | A | * | 6/2000 | Chen et al. | 292/202 |
| 6,082,786 | A | * | 7/2000 | Stephens et al. | 292/102 |
| 6,373,692 | B1 | * | 4/2002 | Cheng | 361/679.59 |

(Continued)

FOREIGN PATENT DOCUMENTS

| | | | |
|---|---|---|---|
| JP | 2004-323043 | A | 11/2004 |
| JP | 2005-521853 | A | 7/2005 |

(Continued)

OTHER PUBLICATIONS

International Search Report dated Jun. 11, 2009 for Application No. PCT/KR2008/006335, 2 pages.
Korean Notice of Allowance dated May 18, 2009 for Application No. 10-2007-0111910 with English translation 3 pages.

*Primary Examiner* — Janet M Wilkens
*Assistant Examiner* — Andrew Roersma
(74) *Attorney, Agent, or Firm* — Fish & Richardson P.C.

(57) ABSTRACT

The present invention forms a supporting part that contacts a wall surface of a rotational shaft of an opening and closing button that opens and closes a container, such that when the opening and closing button is pressed, the supporting part contacts the wall surface to prevent the stress concentration phenomenon from being generated on the rotational shaft when the opening and closing button is pressed.

8 Claims, 6 Drawing Sheets

(56) References Cited

U.S. PATENT DOCUMENTS

| | | | | |
|---|---|---|---|---|
| 6,648,149 | B2 * | 11/2003 | Robertson | 211/26 |
| 6,721,183 | B1 * | 4/2004 | Chen et al. | 361/726 |
| 7,427,086 | B2 * | 9/2008 | Park et al. | 292/95 |
| 2005/0001436 | A1 * | 1/2005 | Ramsauer | 292/122 |
| 2006/0103140 | A1 * | 5/2006 | Bella et al. | 292/95 |
| 2006/0192469 | A1 * | 8/2006 | Koo | 312/330.1 |
| 2007/0210684 | A1 * | 9/2007 | Lin et al. | 312/223.2 |

FOREIGN PATENT DOCUMENTS

| | | | |
|---|---|---|---|
| KR | 10-1999-0060073 | A | 7/1999 |
| KR | 2005-017056 | A | 2/2005 |
| KR | 10-2006-0082334 | A | 7/2006 |
| KR | 2006-094587 | A | 8/2006 |

* cited by examiner

CONTAINER OF REFRIGERATOR

TECHNICAL FIELD

The present invention relates to a container of a refrigerator.

BACKGROUND ART

Generally, a refrigerator is a device that stores foods at a low temperature. The refrigerator includes a freezing compartment, a refrigeration compartment, and a vegetable compartment. The vegetable storage chamber is drawably provided with a basket.

Herein, an opened upper side of the basket is provided with a cover, which is fixed to the inside of the refrigerator. And, the front of the basket is coupled with a basket door. Also, the basket door is provided with an opening and closing button, such that the basket door is selectively and rotatably coupled to the basket. In other words, if the opening and closing button is pressed, the basket door rotates from the basket.

Meanwhile, in the conventional container, stress is intensively applied to the rotational shaft of the opening and closing button by force pressing the opening and closing. As a result, the rotational shaft is bent in a direction of force and if the force is removed, the rotational shaft is returned to an original position. As such, if an operation, which presses and releases the opening and closing button, is repeated, fatigue strength is accumulated on the rotational shaft of the opening and closing button, such that the rotational shaft may be damaged.

DISCLOSURE OF INVENTION

Technical Problem

The present invention proposes to improve the above-mentioned problems. It is an object of the present invention to provide a container of a refrigerator capable of improving a phenomenon of damage of a rotational shaft due to fatigue strength.

Technical Solution

To achieve the above objects, there is provided a container of a refrigerator comprising: a basket received in a storage compartment; a basket door rotatably coupled to a front of the basket; a handle formed at a front of the basket door; an opening and closing button that is coupled to the basket door by a rotational shaft and restricts the basket door to the basket; and a supporting part that is formed at the rotational shaft of the opening and closing button and contacts an outer surface of the basket door when the opening and closing button is pressed.

Advantageous Effects

With the container of the refrigerator according to the embodiment of the present invention forming the above-mentioned configuration, the support part contacting the outer surface of the container is formed at the rotational shaft of the opening and closing button, making it possible to prevent the rotational shaft from being bent or the increase of fatigue strength even when the opening and closing button is pressed. As a result, even though the operation, which presses and releases the opening and closing button, is repeated, the damage of the rotational shaft of the opening and closing button can be prevented. With the container of the refrigerator according to the embodiment of the present invention forming the above-mentioned configuration, the support part contacting the outer surface of the container is formed at the rotational shaft of the opening and closing button, making it possible to prevent the rotational shaft from being bent or the increase of fatigue strength even when the opening and closing button is pressed. As a result, even though the operation, which presses and releases the opening and closing button, is repeated, the damage of the rotational shaft of the opening and closing button can be prevented.

BRIEF DESCRIPTION OF DRAWINGS

The above and other objects, features and advantages of the present invention will become apparent from the following description of preferred embodiments given in conjunction with the accompanying drawings, in which.

MODE FOR THE INVENTION

Figure 1:
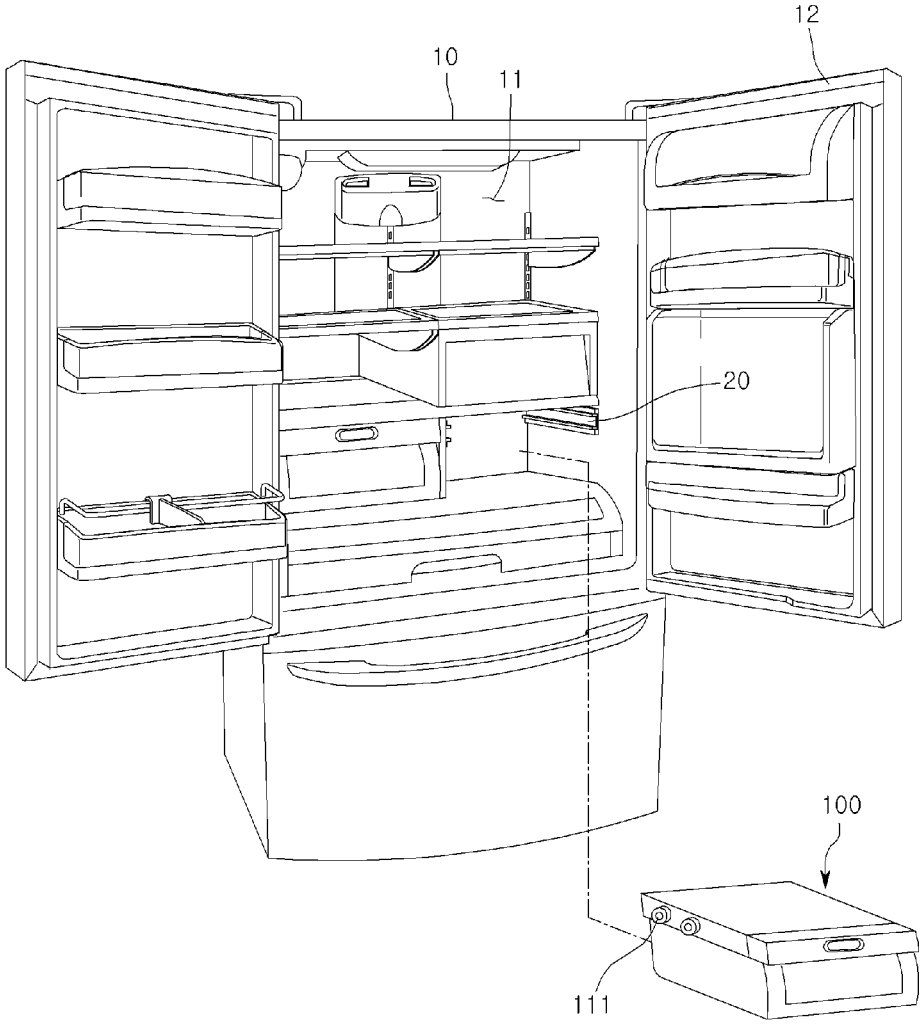
FIG. 1 is a perspective view showing a refrigerator according to an embodiment of the present invention.

FIG. 1 is a perspective view showing a refrigerator according to an embodiment of the present invention.

Referring to FIG. 1, the refrigerator include a main body 10 in which a storage compartment 11 is formed and a door 12 that is rotatably provided to a front of the main body 10. The storage compartment 11 may be a freezing compartment and a refrigerating compartment.

In detail, the refrigerating compartment is provided with a plurality of shelves and a container 100. The container 100 may be supported by guide parts 20 that are disposed at both sides of the refrigerating compartment. Both sides of the container 100 may be provided rollers 111 that the container contacts a guide rail in a cloud shape. The container 100 may be drawn in and from the storage compartment 11 along the guide rail. Hereinafter, among the containers 100, one example of an installation structure of a vegetable compartment 100 will be described.

Figure 2:
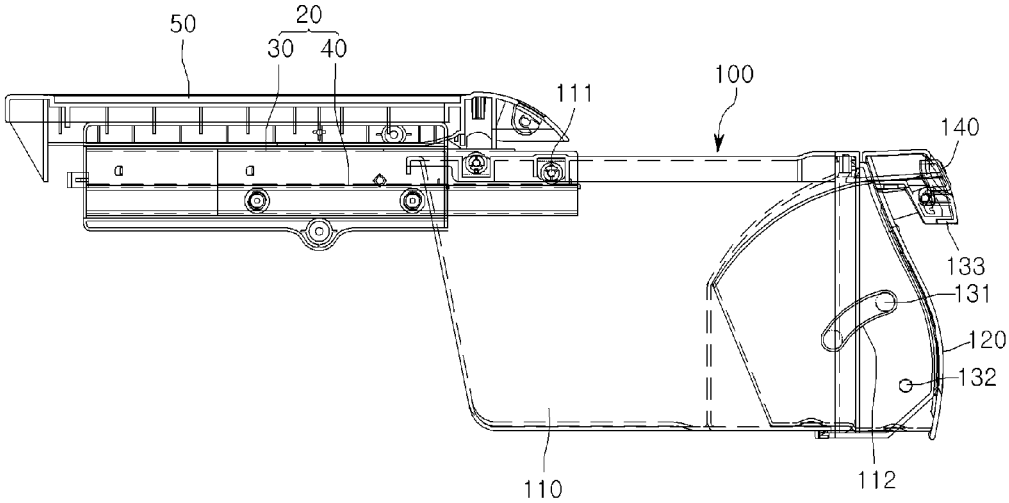
FIG. 2 is a perspective view showing a drawing structure of a container of the refrigerator.

FIG. 2 is a perspective view showing a drawing-out structure of the container of the refrigerator.

Referring to FIG. 2, both sides of the storage compartment 11 is provided with the guide part 20. The guide part 20 is provided with a rail guide 30 and a sliding rail 40. The sliding rail 40 is slidably coupled to the rail guide 30 and the sliding rail 40 receives a roller 111 of the container 100. Therefore, the roller 111 rotates along the sliding rail 40 to move the storage container 100. A length of the sliding rail determines a drawing out distance of the container 100. The rail guide 30 and the sliding rail 40 are coupled to each other by forming a cross section vertical to a length direction in an approximately "ㄷ" shape.

The container 100 includes a basket 110. An upper side of the basket 110 has an opened shape and is received to be drawn from the storage compartment 11.

The upper side of the basket 110 is disposed with a cover 50 to cover the upper side of the basket 110. And, the cover 50 may fixedly be installed to an upper end of the guide part 20. The cover 50 may be formed in a panel shape so that it seals the opened upper side of the basket 110. Therefore, the cover 50 interrupts the inflow of all cooling air inside the storage compartment into the inside of the basket 110, such that the inside of the basket is maintained at a proper temperature for storing vegetables.

The front of the basket 110 is rotatably coupled to the basket door 120. In detail, lower parts of both sides of the basket 110 are formed with hinge shafts 132 and a point spaced upwardly from the hinge shaft 132 is formed with a guide slot 112. And, the basket door 120 may be formed with a guide protrusion 131 that is inserted into the guide slot 112. Therefore, when the basket door 120 rotates based on the hinge shaft 132, the guide protrusion 131 of the basket door 120 moves along the guide slot 112 of the basket 110. And, the guide protrusion 131 is engaged with the end of the guide slot 112, such that a rotational angle of the basket door 120 is limited. The basket door 120 is opened within the range of the predetermined angle. The basket door 120 can open and close the inside of the basket 110 even in the state where the basket 110 is drawn in the storage chamber 11.

The front upper side of the basket door 120 is formed with a handle 133. Also, the upper side of the handle is provided with the opening and closing button 140 so that the basket door 120 is restricted to the basket 110. Therefore, when a user grabs the handle 133 and presses the opening and closing button 140, the restriction of the basket door 120 to the basket 110 is released. At this time, when a user pulls the handle 133, the basket door 120 opens the front of the basket 110 while rotating to a front side based on the hinge shaft 132. To the contrary, if a user pulls the handle 133 in the state where the opening and closing button 140 is not pressed, the basket 110 is drawn from the storage compartment 11.

Figure 3:
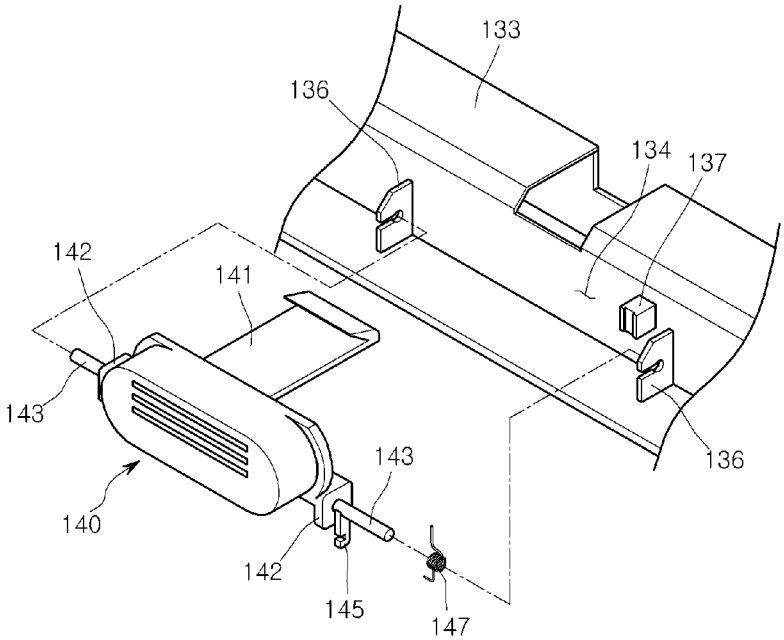
FIG. 3 is an exploded perspective view showing an installation structure of an opening and closing button of the container.
Figure 4:
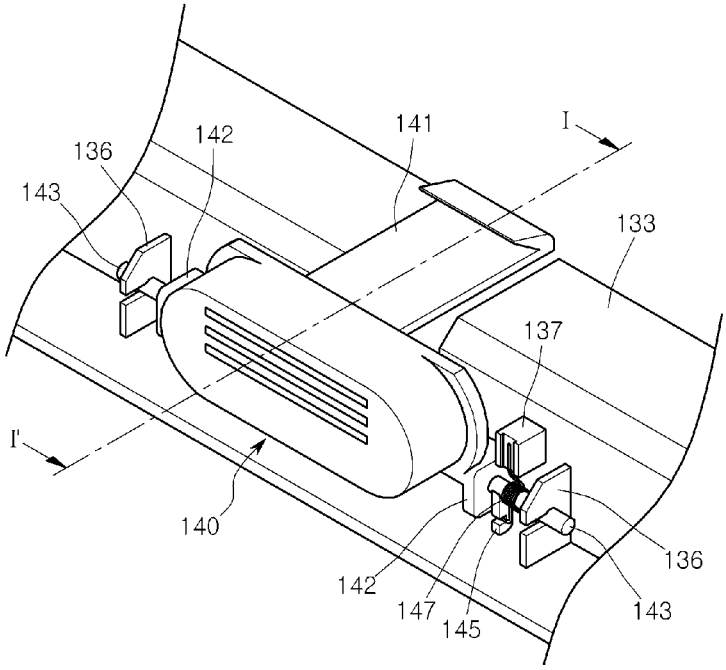
FIG. 4 is a perspective view showing an assembled state of the opening and closing button and the container.

FIG. 3 is an exploded perspective view showing an installation structure of the opening and closing button of the container and FIG. 4 is a perspective view showing an assembled state of the opening and closing button and the container.

Referring to FIGS. 3 and 4, the front of the basket door 120 is formed with a receiving part 134 so that a part of the opening and closing button 140 can be received. The receiving part 134 may have a collapsed form to a rear side of the basket door 120.

The opening and closing button 140 may be formed a hook 141 that is extended to the rear side of the basket door 120 and is engaged with the front side of the basket 110.

Both sides of the opening and closing button 140 may be provided supporting parts 142 that contacts an outer surface of the basket door 120 when the opening and closing button 140 rotates. The respective supporting parts 142 may be formed in a polygonal plate shape. FIGS. 3 and 4 show the supporting part 142 in a rectangular plate shape.

A structure where the supporting part 142 contacts the basket door 120 will be described in detail below.

The rotational shafts 143 that can be rotated in the state where the opening and closing button 140 is connected to the basket door 120 are extended to the respective supporting parts 142. As another possible embodiment, the rotational shaft is extended to both sides of the opening and closing button 140 and any point spaced from a distal end of the rotational shaft 143 may be formed with the supporting part 142.

Meanwhile, the receiving part 134 of the basket door 120 may be formed with a supporting rib 136 so that the rotational shaft 143 is rotatably supported. A pre-determined depth of collapsing part is formed in the supporting rib 136 so that the rotational shaft 143 is fitted therein.

A side of the opening and closing button 140 is provided with an elastic member 147 such that elastic force can be applied in a direction where the opening and closing button 140 is engaged with an upper end of the basket 110. For example, one end of the elastic member 147 is supported to the rotational shaft 143 in the state where it is inserted into the rotational shaft 143 and the other end thereof may be supported to the basket door 120. And, in the state where force is not applied to the opening and closing button 140, a state where the hook 141 is engaged with the upper end of the basket 110 is maintained. At this time, a first supporting protrusion 145 is formed to be protruded so that one end of the elastic member 147 can be fitted and supported in the rotational shaft 143. A second supporting protrusion 137 can be formed so that other end of the elastic member 147 can be fitted and supported in the receiving part 134 of the basket door 120. The elastic member 147 can be installed only at the rotational shaft of one side or both sides of the opening and closing button 140.

Figure 5:
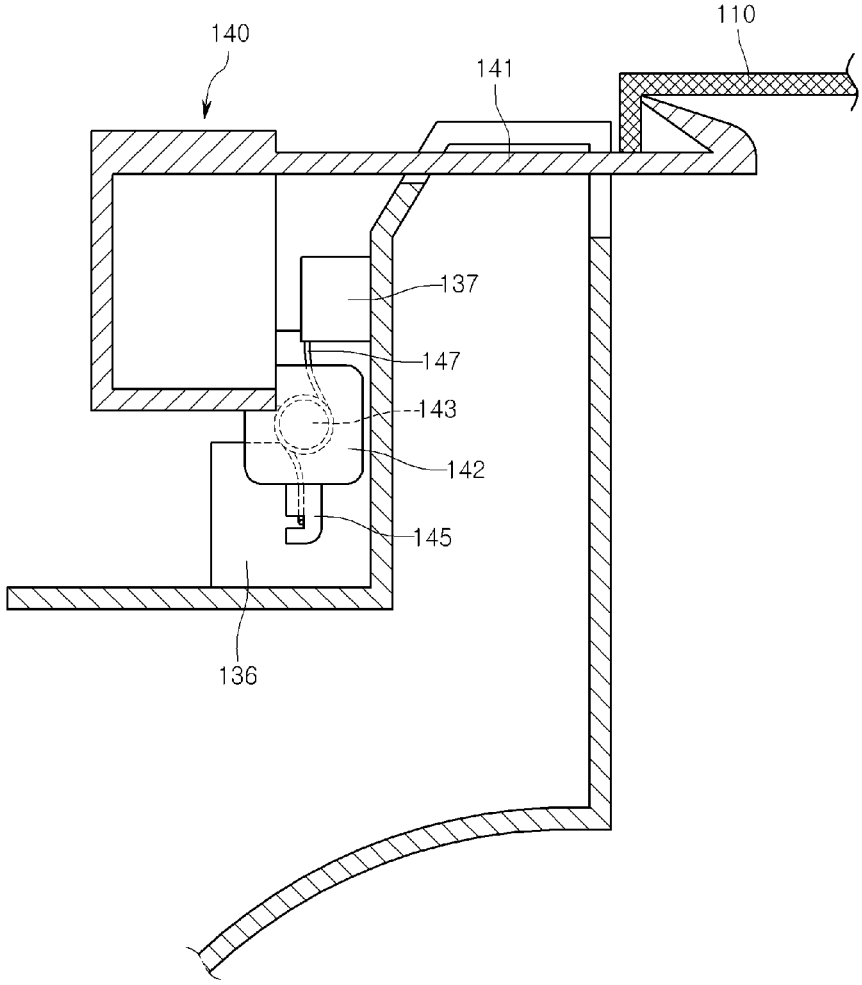
FIG. 5 is a cross-sectional view showing a state taken along line I-I' of FIG. 4.
Figure 6:
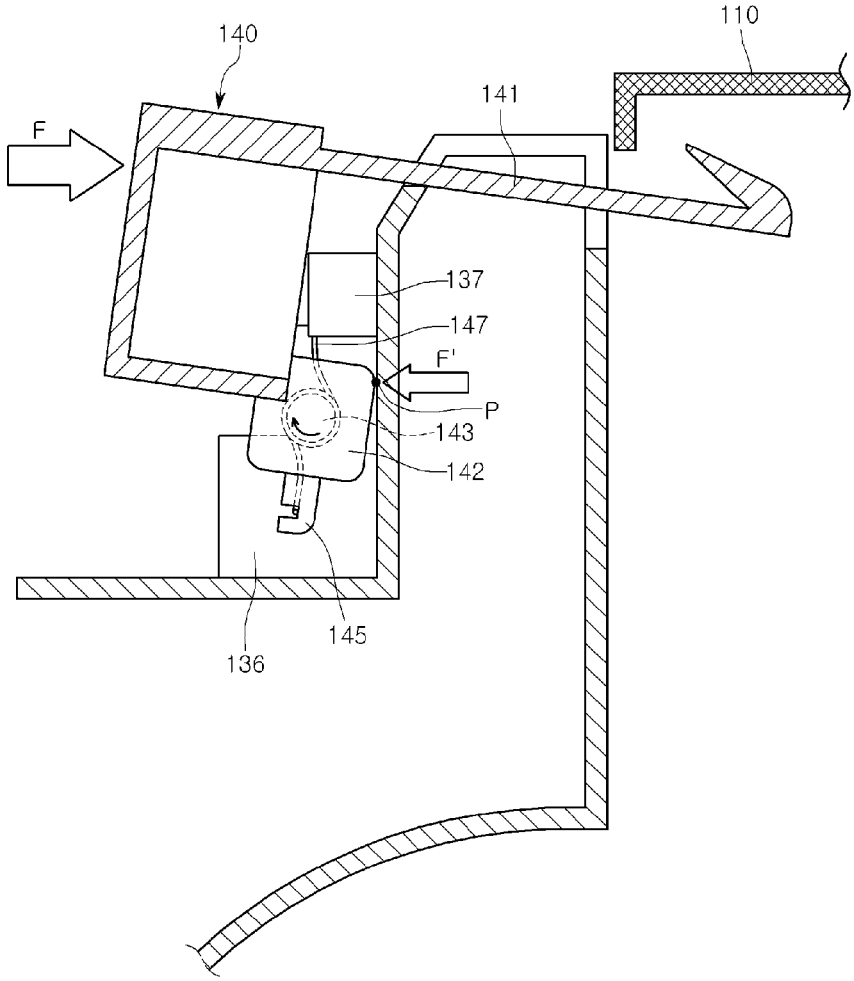
FIG. 6 is a cross-sectional view showing a pressed state of the opening and closing button.

FIG. 5 is a cross-sectional view showing a state taken along line I-I of FIG. 4 and FIG. 6 is a cross-sectional view showing a pressed state of the opening and closing button.

Referring to FIGS. 5 and 6, the supporting part 142 may be slightly spaced from the outer surface of the basket door 120 before the opening and closing button 140 is pressed (see FIG. 5). And, the supporting part 142 of the opening and closing button 140 may contact the outer surface of the basket door 120 when the opening and closing 140 is pressed (see FIG. 6).

For example, the supporting part 142 in the rectangular shape may be formed so that both sides of the opening and closing button 140 may contact the outer surface of the basket door 120. Therefore, when the opening and closing button 140 is not pressed, the supporting part 142 is spaced from the outer surface of the receiving part 134. When the opening and closing button 140 is pressed, the supporting part 142 may contact the outer surface of the receiving part 134.

When the opening and closing button 140 is pressed, since the supporting part 142 contacts the outer surface of the receiving part 134, the phenomenon where the rotational shaft 143 is bent or damaged does not occur.

In detail, when the opening and closing button 140 is pressed, the rotational shaft 143 rotates and at the same time, is subjected to force in a straight direction near a horizontal direction. At this time, when there is no the supporting part 142, the rotational shaft 143 is bent in the direction of force. However, since the supporting part 142 contacts the outer surface of the receiving part 134, even though pressure is applied to the rotational shaft 143, the bent phenomenon does not occur.

The operation of the present invention configured as described above will be described.

Referring to FIG. 5, in the state where the opening and closing button 140 is not pressed, the hook 141 of the opening and closing button 140 is engaged with the front side of the basket 110. At this time, the opening and closing button 14 time, the opening and closing button 140 is restricted so that the basket door 120 is opened from the basket 110. Therefore, when the handle 133 is pulled, both the basket 110 and the basket door 120 are drawn from the storage compartment.

Referring to FIG. 6, in the state where a user grabs the handle 133, when the opening and closing button 140 is pressed, the opening and closing button 140 rotates at a predetermined angle based on the rotational shaft 143. And, the predetermined portion of the supporting part 142 contacts the outer surface of the basket door 120 at a P point. At this time, force F pressing the opening and closing button 140 is transferred to the receiving part 134, thereby generating repulsive force F. Therefore, since a stress concentrating phenomenon does not occur on the rotational shaft 143, it can prevent the rotational shaft 143 from being bent by the stress concentration or damaged by the fatigue strength.

At this time, when the handle 133 is pulled, the basket door 120 rotates based on the hinge shaft 132 to open the front of the basket 110. Therefore, a user can draw foods from the front of the basket 110.

When the basket door 120 is closed, the hook 141 of the opening and closing button 140 is engaged with the front of the basket 110. At this time, the opening and closing button 140 is restricted so that the basket door 120 is not opened from the basket 110.

Next, another example of the supporting part according to the present invention will be described. The remaining configuration other than the shape of the supporting part 152 is substantially the same as one described above and therefore, the same components are denoted by the same reference numerals. The description thereof will be omitted.

Figure 7:
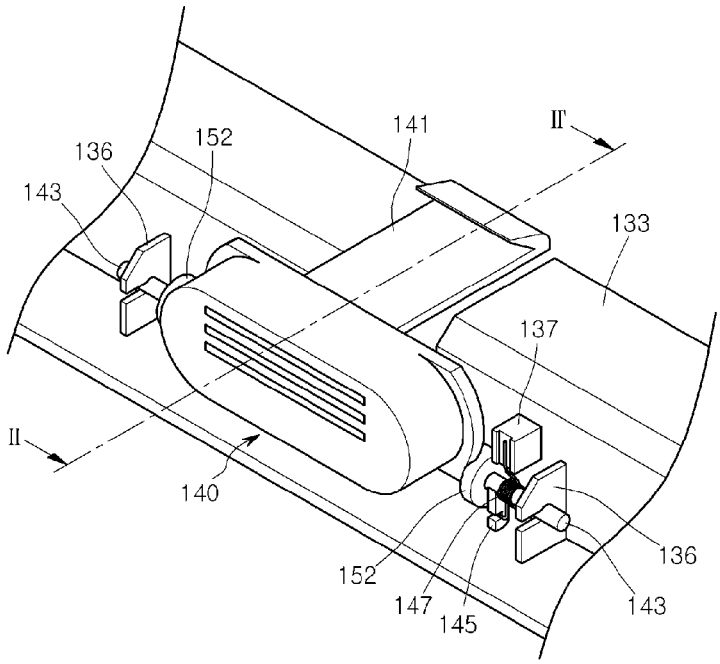
FIG. 7 is a perspective view showing another example of the opening and closing button according to the present invention.

FIG. 7 is a perspective view showing another example of the opening and closing button according to the present invention.

Referring to FIG. 7, each of the supporting parts 152 may be formed at both sides of the opening and closing button 140 in a disk type or a circular arc type. At this time, the rotational shaft 143 may be formed at the center of the respective supporting part 152.

Figure 8:
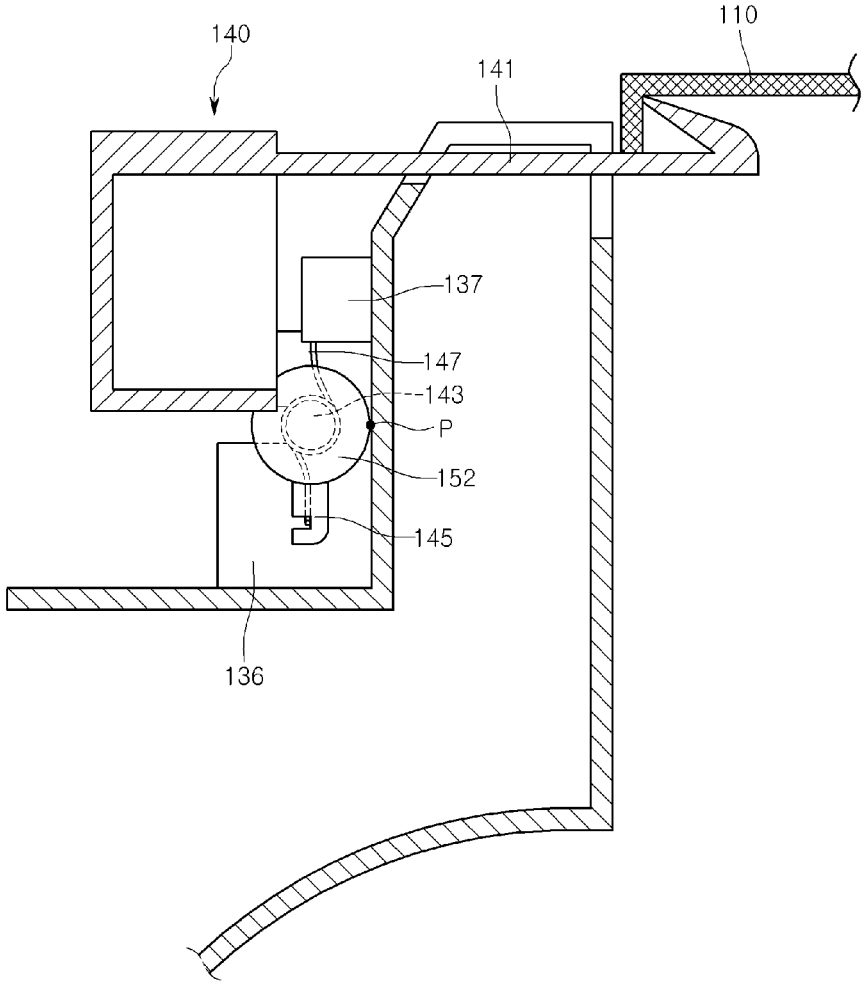
FIG. 8 is a cross-sectional view showing a state taken along line II-II' of FIG. 7.

FIG. 8 is a cross-sectional view showing a state taken along line II-II of FIG. 7.

Figure 9:
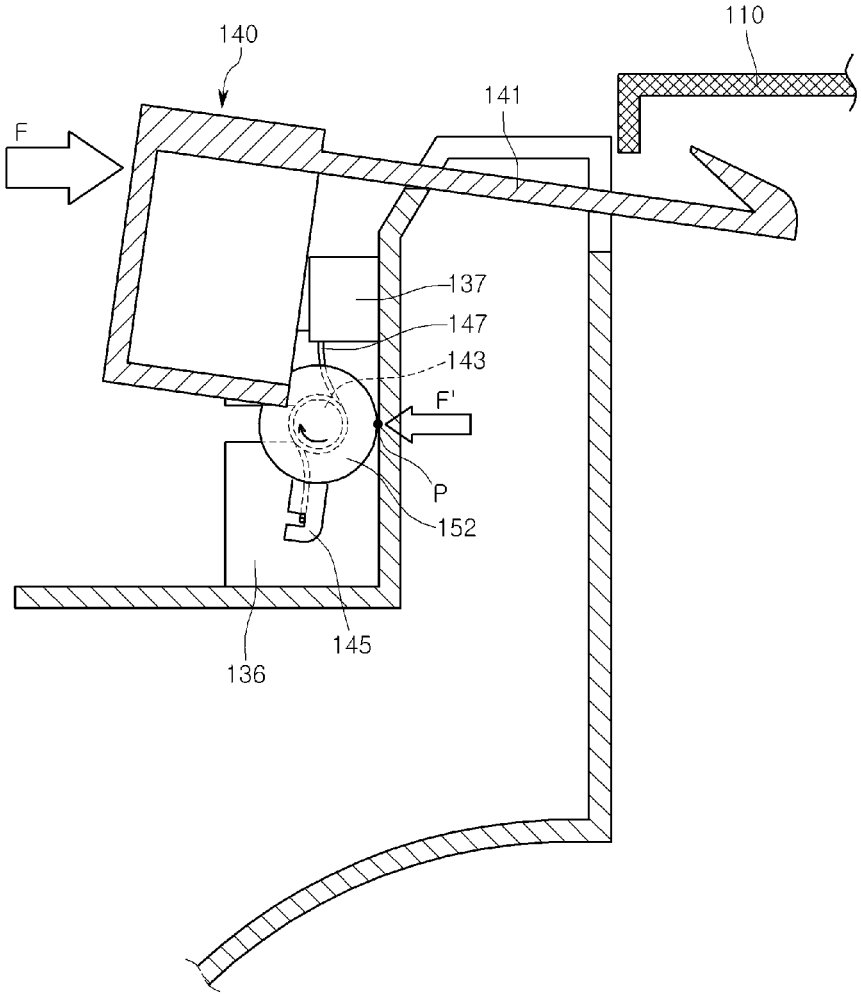
FIG. 9 is a cross-sectional view showing a pressed state of the opening and closing button.

FIG. 9 is a cross-sectional view showing a pressed state of the opening and closing button.

Referring to FIGS. 8 and 9, when the supporting part 152 is formed in a disk type, the supporting part 12 may always contact the outer surface of the basket door 120 at the P point when the opening button 140 is pressed or is not pressed.

Except that the supporting part 152 contacts the outer surface of the receiving part of the basket door 120 when the opening and closing button 140 is pressed or is not pressed the operation of the supporting part is substantially the same as one of the previous embodiments.

Those skilled in the art will appreciate that the conceptions and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth in the appended claims.

The invention claimed is:

1. A container of a refrigerator comprising:

a basket received in a storage compartment;

a basket door rotatably coupled to a front of the basket;

a handle formed at a front of the basket door, the handle extending frontward and being bent downwardly to enable a user to grab a rear surface of the handle;

an opening and closing button that is coupled to the basket door by multiple rotational shafts and restricts the basket door to the basket, the multiple rotational shafts extending from both side ends of the opening and closing button and a pressing surface of the opening and closing button being positioned at a front surface of the handle;

a hook that extends from a rear of the opening and closing button and that selectively engages with the basket, the multiple rotational shafts and the hook being arranged perpendicular to each other;

at least one supporting part that is formed at at least one of the multiple rotational shafts of the opening and closing button and that contacts an outer surface of the basket door when the opening and closing button is pressed;

an elastic member that is fitted in at least one of the multiple rotational shafts and generates elastic force in a direction where the opening and closing button is engaged with the basket;

a first supporting protrusion that is formed on the at least one of the multiple rotational shafts to support a first end of the elastic member; and a second supporting protrusion that is formed on the basket door to support a second end of the elastic member, the second end of the elastic member being different from the first end of the elastic member, wherein the basket door is configured to open when the rear surface of the handle is pulled and the pressing surface of the opening and closing button is pressed, wherein pressing the pressing surface of the opening and closing button causes the supporting part to rotate toward the outer surface of the basket door and, at a position where the supporting part contacts the outer surface of the basket door, the hook is disengaged, thereby enabling the basket door to open based on a user pulling the rear surface of the handle.

2. The container of a refrigerator according to claim 1, wherein the supporting part is spaced from an outer surface of the basket door in the state where the opening and closing button is not pressed.

3. The container of a refrigerator according to claim 2, wherein the supporting part is a polygonal shape having a cross-sectional area larger than that of the rotational shaft.

4. The container of a refrigerator according to claim 1, wherein the supporting part is a circular plate having a cross-sectional area larger than that of the rotational shaft and is maintained in the state where it contacts the outer surface of the basket door even in the state where the opening and closing button is not pressed.

5. The container of a refrigerator according to claim 1, wherein the basket door is formed with a supporting rib to rotatably support the rotational shaft and the supporting part is formed at either side of the opening and closing button.

6. The container of a refrigerator according to claim 1, further comprising:

a guide protrusion that is protruded at any one of the side surface of the basket door and the side surface of the basket; and a guide slot that is formed at the other of the side surface of the basket door and the side surface of the basket to establish a movement limitation of the guide protrusion.

7. The container of a refrigerator according to claim 1, wherein the first supporting protrusion protrudes downward from the at least one of the multiple rotational shafts.

8. The container of a refrigerator according to claim 1, wherein the elastic member generates elastic force in a direction that presses the hook upward and wherein pressing the pressing surface of the opening and closing button causes the hook to rotate downward.

* * * * *